US006384543B2

(12) United States Patent
Buij et al.

(10) Patent No.: US 6,384,543 B2
(45) Date of Patent: May 7, 2002

(54) SWITCHING DEVICE

(75) Inventors: Arnold Willem Buij; Adrianus Martinus Johannes De Bijl, both of Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 09/826,619

(22) Filed: Apr. 5, 2001

(51) Int. Cl.[7] ..... H05B 37/02

(52) U.S. Cl. ..... 315/244; 219/DIG. 4; 219/DIG. 5

(58) Field of Search ..... 315/DIG. 4, 244, 315/219, DIG. 5

(56) References Cited

U.S. PATENT DOCUMENTS 4,081,718 A 3/1978 Kaneda ..... 315/244
5,726,537 A 3/1998 Huber et al. ..... 315/311
5,965,985 A * 10/1999 Nerone ..... 315/DIG. 4

* cited by examiner

*Primary Examiner*—David Vu

(57) ABSTRACT

A half-bridge converter for operating a discharge lamp utilizes a non-linear coil in series with the discharge lamp. Suitable proportioning ensures an unambiguous relation between the frequency of the lamp current and the lamp power over a comparatively large range of lamp power.

5 Claims, 3 Drawing Sheets

SWITCHING DEVICE

BACKGROUND OF THE INVENTION

The invention relates to a switching device for powering a lamp, including input terminals for connection to a supply voltage source, an inverter for generating a high-frequency lamp current which includes switching means which are coupled to the input terminals, an external drive circuit which is coupled to the switching means in order to generate a control signal of frequency f for controlling the switching means so as to be alternately conductive and non-conductive, a dimming circuit which is coupled to the control circuit in order to adjust the frequency f, and a load circuit which is coupled to the switching means and includes a series connection of an inductive element and lamp connection terminals which are connected by a circuit which includes a first capacitive element.

The invention also relates to a compact lamp.

A switching device of the kind set forth is known. A user of the known switching device can adjust the light flux of a lamp powered by the switching device by adjusting the frequency of the control signal by means of the dimming circuit. The lamp can thus be dimmed by means of comparatively simple means. When the capacitance of the capacitive element is chosen to be comparatively low, it is ensured that the relationship between the frequency of the control signal and the lamp power is unambiguous throughout the power range of the lamp. However, the range in which the frequency of the control signal should be adjustable then becomes comparatively large. This gives rise to problems in practice, because the integrated circuit that is often included in the control circuit usually is not capable of generating a control signal having a comparatively high frequency. Increasing the capacitance of the capacitive element reduces the range over which the frequency must be adjustable. It is a drawback of a higher capacitance of the capacitive element, however, that the relation between the frequency of the control signal and the lamp power usually is not unambiguous throughout the power range of the lamp. In practice the dimming range is thus limited and instabilities are liable to occur in the lamp at comparatively low values of the lamp power.

SUMMARY

It is an object of the invention to provide a switching device such that a lamp powered by means of the switching device can be dimmed over a large range by adjustment of the frequency of the control signal over a comparatively small range, the operation of the lamp nevertheless being stable throughout the dimming range.

To this end, a switching device of the kind set forth in accordance with the invention is characterized in that the inductive element is proportioned such that $$L20/L\ \max \leqq 0.7,$$

wherein Lmax is the instantaneous value of the inductance of the inductive element when the amplitude of the current in the inductive element is maximum and the lamp power has its maximum value, and L20 is the instantaneous value of the inductance of the inductive element when the amplitude of the current in the inductive element is maximum and the lamp power amounts to 20% of its maximum value.

When the frequency of the control signal in a switching device in accordance with the invention is increased by means of the dimming circuit, the frequency of the current in the load circuit also increases. As a result, the operating voltage of the lamp and the amplitude of the current through the inductive element also increase. Due to the increase of the amplitude of the current through the inductive element, the effective value of the inductance of the inductive element decreases because the instantaneous value of the inductance is comparatively low during a part of each high-frequency period of the current through the inductive element and a considerable degree of saturation of said inductive element occurs. The decrease of the effective value of the inductance in response to an increase of the frequency of the control signal ensures that an unambiguous relation exists between the frequency of the control signal and the lamp power over a comparatively large range of the lamp power. In other words, the lamp can be dimmed over a large range and its operation is stable throughout the dimming range.

Favorable results have been found notably for embodiments of a switching device in accordance with the invention wherein L20/Lmax≦0,5.

Favorable results have also been found for embodiments of a switching device in accordance with the invention in which the switching means include a series connection of two switching elements so that the inverter constitutes a so-called bridge circuit.

It has also been found that the inductive element in a switching device in accordance with the invention may have a very simple construction. Attractive results have notably been achieved by means of embodiments of a switching device in accordance with the invention in which the inductive element includes an I-core provided with a winding of copper wire.

A switching device in accordance with the invention may have a comparatively simple and hence compact construction so that it is perfectly suitable for use in the electronic ballast of a compact lamp which includes a light-transmitting discharge vessel which is provided with a filling containing a noble gas and with two electrodes, a lamp housing which is connected to the discharge vessel, a lamp cap which is provided with electrical contacts and is connected to the lamp housing, and an electronic ballast which is coupled between the electrodes and the contacts for generating a lamp current from a supply voltage.

An embodiment of a switching device in accordance with the invention and an embodiment of a compact lamp in accordance with the invention will be described in detail hereinafter with reference to a drawing. Therein:

DETAILED DESCRIPTION OF THE PREFERRED EMBODIMENTS

Figure 1:
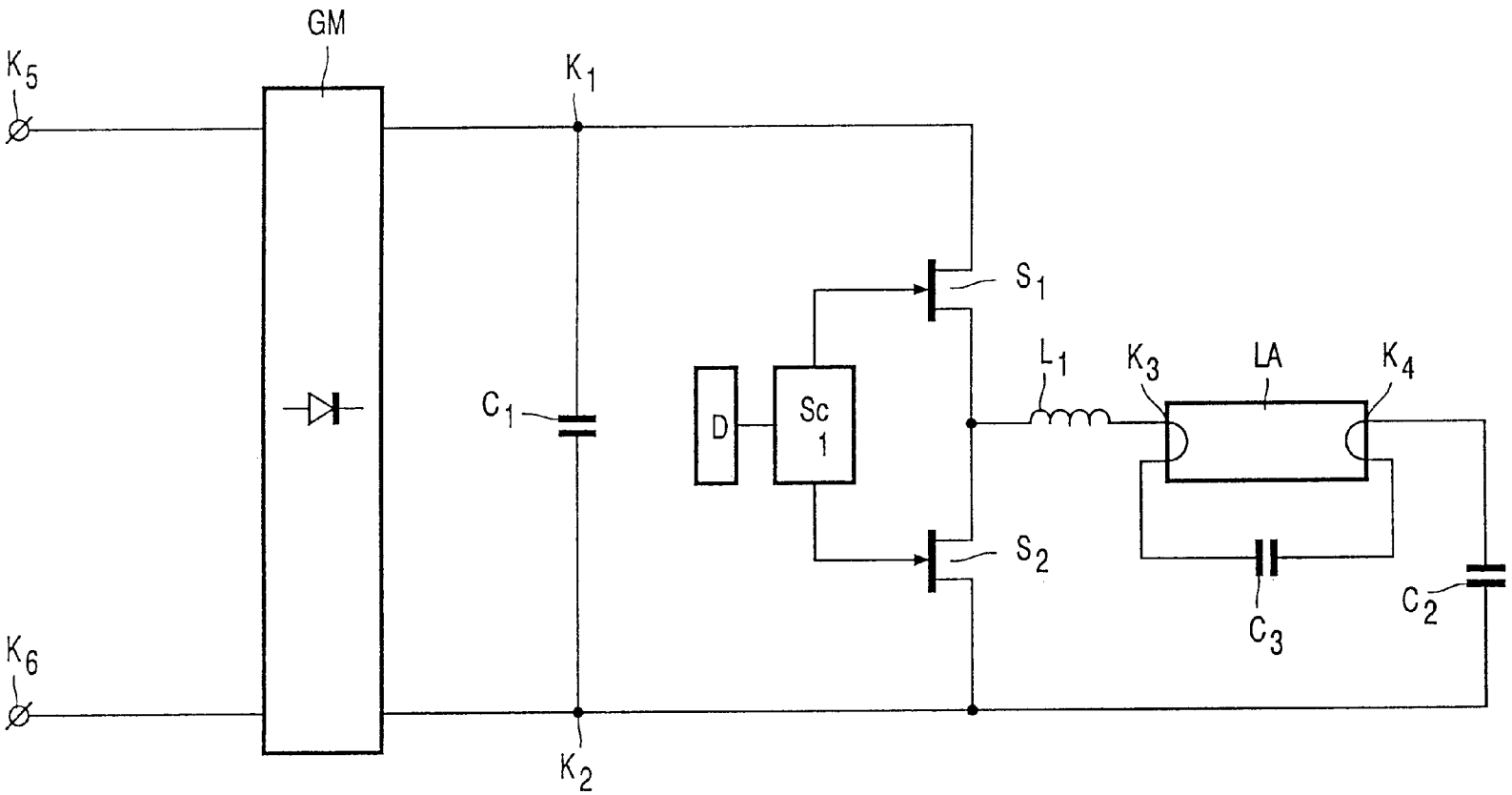
FIG. 1 is a diagrammatic view of an embodiment of a switching device in accordance with the invention whereto a lamp is connected.

The references K5 and K6 in FIG. 1 denote a first and a second terminal, respectively, for connection to the mains voltage (50 Hz, 220 V). The terminal K5 is connected to a first input of a rectifier GM which is formed by a diode bridge in the present embodiment. The terminal K6 is connected to a second input of the rectifier GM. Respective output terminals of the rectifier GM are connected to the input terminal K1 and to the input terminal K2, respectively. The input terminal K1 is connected to the input terminal K2 via a capacitor C1. The terminals K5 and K6, the diode bridge GM and the capacitor C1 together constitute a supply voltage source whereto the input terminals are connected. All other components and circuit elements together constitute an inverter for generating a high-frequency lamp current. The capacitor C1 is bridged by a series connection of a first switching element S1 and a second switching element S2, constituting switching means in the present embodiment. Respective control electrodes of the first switching element S1 and of the second switching element S2 are connected to respective outputs of a control circuit Sc1 for generating a control signal of frequency f for rendering the first and the second switching element alternately conductive and non-conductive. An input of the control circuit Sc1 is connected to an output of a circuit element D. The circuit element D constitutes a dimming circuit for adjusting the frequency f. The second switching element S2 is bridged by a series connection of a coil L1, a lamp connection terminal K3, a lamp La, a lamp connection terminal K4 and a capacitor C2. The lamp La is bridged by a capacitor C3 which constitutes a first capacitive element in the present embodiment. The coil L1, the lamp connection terminals K3 and K4 and the capacitors C2 and C3 together constitute a load circuit in the present embodiment. The coil L1 constitutes an inductive element.

The operation of the embodiment shown in FIG. 1 is as follows.

Figure 3:
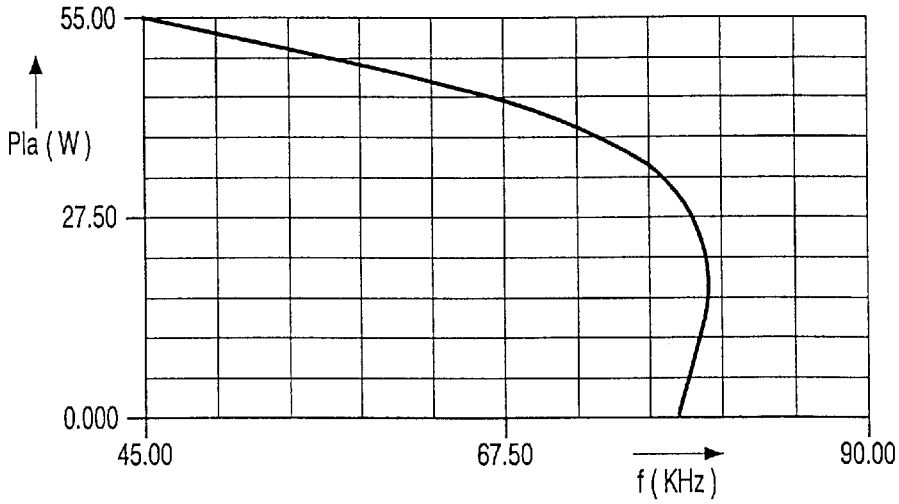
Figure 4:
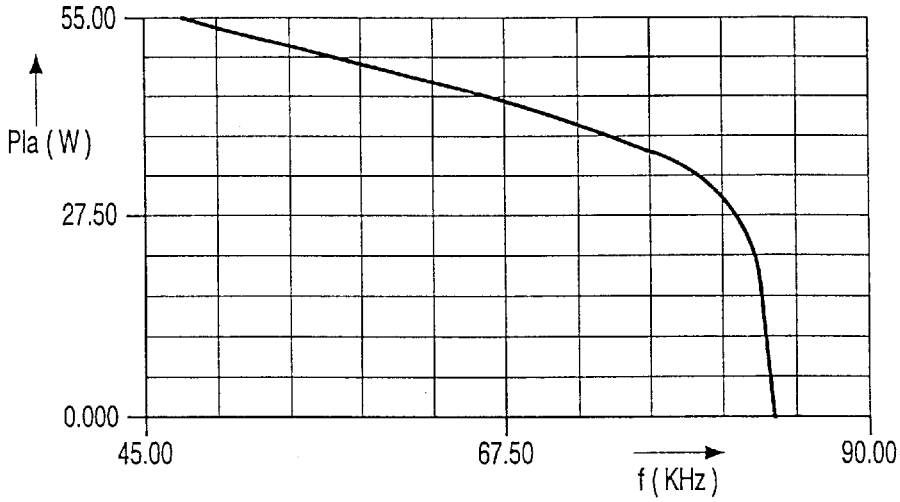
Figure 5:
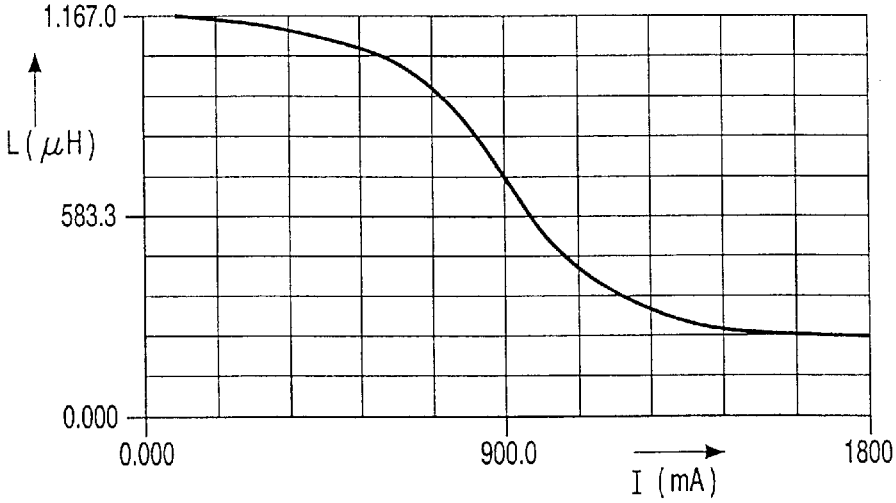
FIG. 5 shows the inductance of an inductive element of a practical implementation of the embodiment shown in FIG. 1, that is, as a function of the instantaneous value of the amplitude of the current through the inductive element.

When the terminals K5 and K6 are connected to the mains voltage (220 V, 50 Hz), the control circuit Sc1 makes the switching elements S1 and S2 alternately conductive and non-conductive. Consequently, a substantially square-wave high-frequency voltage is present at a common point of the two switching elements. Because of this substantially square-wave high-frequency voltage, a high-frequency current flows in the load circuit of the inverter. Consequently, a high-frequency current also flows through the lamp La. When a user increases the frequency f of the control signal by means of the circuit element D, the frequency of the high-frequency current through the coil L1 also increases. As a result, the lamp power decreases and also the light flux of the lamp whereas the amplitude of the high-frequency current through the coil L1 increases. If the coil L1 were chosen to be such that the effective inductance was substantially constant for any adjusted value of the lamp power, the relation between the frequency f and the lamp power would be as shown in FIG. 3. In FIG. 3 the frequency f is plotted in kHz along the horizontal axis and the lamp power is plotted in W along the vertical axis. The lamp used was a low-pressure mercury discharge lamp of the type PL (Philips) having a rated power of 55 W. It can be seen that for lamp powers of less than approximately 27.5 W there is no longer an unambiguous relation between lamp power and frequency f. Consequently, it is not possible to adjust a lamp power which is lower than approximately 27.5 W. However, in accordance with the invention the coil L1 is chosen to be such that a substantial degree of saturation of the coil L1 occurs at a higher frequency and hence also a higher amplitude of the current in the coil L1. The coil L1 is notably proportioned such that approximately:

$$L20/L\ \max=0.5,$$

wherein Lmax is the instantaneous value of the inductance of the inductive element when the amplitude of the current in the inductive element is maximum and the lamp power has its maximum value, and L20 is the instantaneous value of the inductance of the inductive element when the amplitude of the current in the inductive element is maximum and the lamp power amounts to 20% of its maximum value. As a result of this saturation, the effective value of the inductance of the coil L1 decreases during the dimming of the lamp. This results in a relation between the frequency f and the lamp power as shown in FIG. 4. This Figure shows that an unambiguous relation exists between the frequency f and the lamp power throughout practically the entire range of the lamp power. These results were also found for a low-pressure mercury discharge lamp of the type PL (Philips) having a rated power of 55 W. FIG. 5 shows the instantaneous value of the inductance of the relevant coil as a function of the instantaneous amplitude of the current in the coil. The instantaneous amplitude of the current in the coil is plotted in mA along the horizontal axis. The instantaneous inductance of the coil is plotted in $\mu$H along the vertical axis. It appears that the saturation of the coil is comparatively high at a comparatively high instantaneous amplitude of the lamp current. The coil used consisted of a winding of copper wire about an I-core made of the material 3C85 (Philips).

Figure 2:
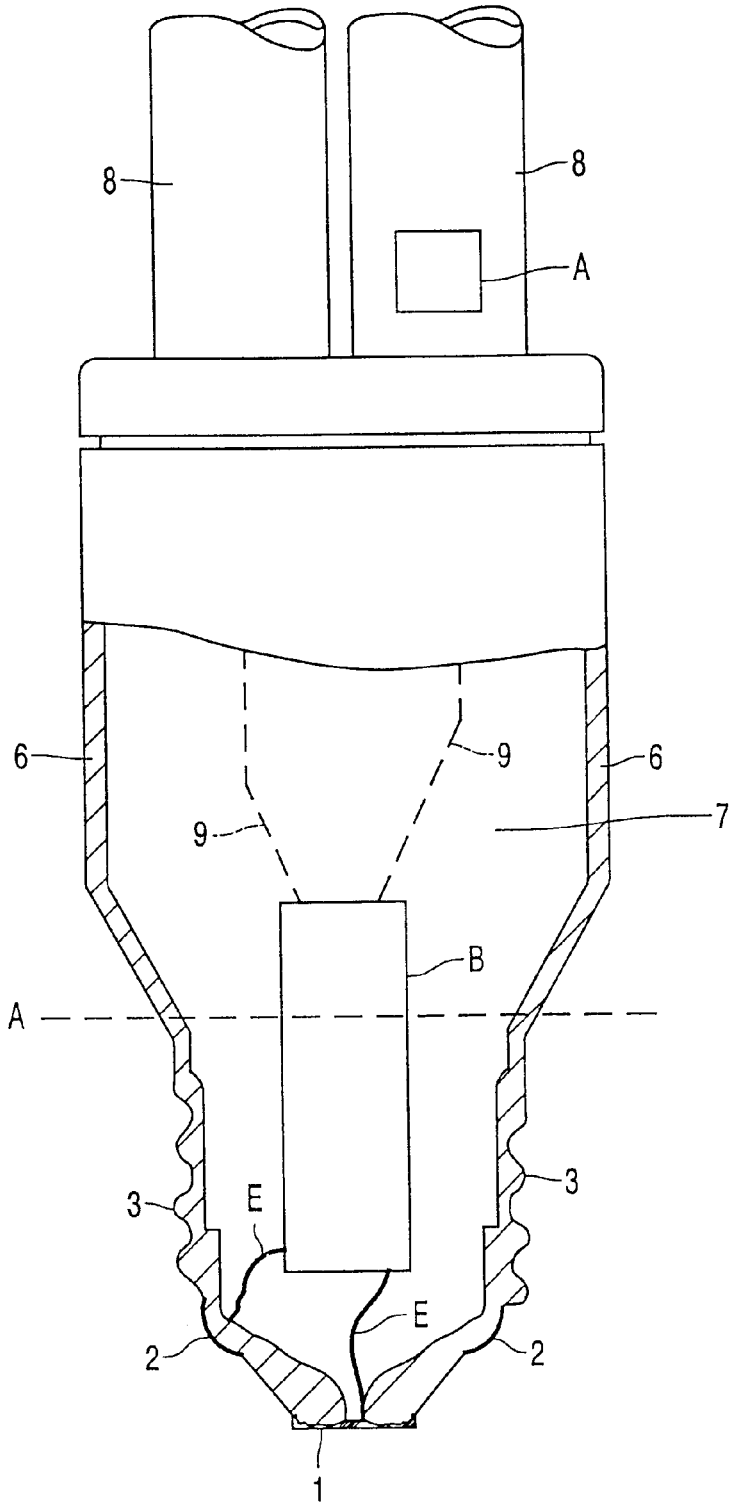
FIG. 2 shows an embodiment of a compact lamp in accordance with the invention, FIGS. 3 and 4 both show a relation between lamp power and frequency of the lamp current.

The reference numeral 8 in FIG. 2 denotes a light-transmitting discharge vessel provided with a filling containing mercury and a noble gas and with two electrodes (not shown). A luminescent layer is provided on the wall of the discharge vessel. The reference numeral 6 denotes a lamp housing which is connected to the discharge vessel 8 and the reference numeral 3 denotes a lamp cap which is provided with electrical contacts (1 and 2) and is connected to the lamp housing. The reference B is a diagrammatic representation of a switching device in accordance with the invention which is coupled between the contacts (1, 2), via the conductors E, and the electrodes (via the conductors 9) for generating a high-frequency lamp current.

What is claimed is:

1. A switching device for powering a lamp, including input terminals for connection to a supply voltage source, an inverter for generating a high-frequency lamp current which includes switching means which are coupled to the input terminals, an external drive circuit which is coupled to the switching means in order to generate a control signal of frequency f for controlling the switching means so as to be alternately conductive and non-conductive, a dimming circuit which is coupled to the control circuit in order to adjust the frequency f, and a load circuit which is coupled to the switching means and includes a series connection of an inductive element and lamp connection terminals which are connected by a circuit which includes a first capacitive element, characterized in that the inductive element is proportioned such that $$L20/L\ \max \leqq 0.7,$$

wherein Lmax is the instantaneous value of the inductance of the inductive element when the amplitude of the current in the inductive element is maximum and the lamp power has its maximum value, and L20 is the instantaneous value of the inductance of the inductive element when the amplitude of the current in the inductive element is maximum and the lamp power amounts to 20% of its maximum value.

2. A switching device as claimed in claim 1, wherein $L_{20}/L_{max} \leqq 0.5$.

3. A switching device as claimed in claim 1 or 2, wherein the switching means include a series connection of two switching elements.

4. A switching device as claimed in claim 3, wherein the inductive element includes an I-core provided with a winding of copper wire.

5. A compact lamp which includes a light-transmitting discharge vessel which is provided with a filling containing a noble gas and with two electrodes, a lamp housing which is connected to the discharge vessel, a lamp cap which is provided with electrical contacts and is connected to the lamp housing, and an electronic ballast which is coupled between the electrodes and the contacts for generating a lamp current from a supply voltage, characterized in that the electronic ballast includes a switching device as claimed in claim 1.

* * * * *